US006182768B1

(12) United States Patent
Andersson

(10) Patent No.: US 6,182,768 B1
(45) Date of Patent: Feb. 6, 2001

(54) GAS-LIQUID MIXTURE AS WELL AS FIRE-EXTINGUISHING UNIT AND METHOD FOR THE USE THEREOF

(75) Inventor: Jan Andersson, Furulund (SE)

(73) Assignee: Halotron, Inc., Las Vegas, NV (US)

( * ) Notice: Under 35 U.S.C. 154(b), the term of this patent shall be extended for 0 days.

(21) Appl. No.: 09/301,453

(22) Filed: Apr. 29, 1999

Related U.S. Application Data

(62) Division of application No. 08/264,956, filed on Jun. 24, 1994, which is a continuation of application No. 07/853,626, filed on Mar. 19, 1992, now abandoned.

(30) Foreign Application Priority Data

Feb. 5, 1992 (SE) ..... 9200335-9

(51) Int. Cl.[7] ..... A62D 1/08

(52) U.S. Cl. ..... 169/74; 169/89; 239/589; 252/8

(58) Field of Search ..... 169/74, 89, 30; 239/589; 252/2, 8

(56) References Cited

U.S. PATENT DOCUMENTS

| | | | | |
|---|---|---|---|---|
| 2,653,130 | | 9/1953 | Eiseman, Jr. . | |
| 3,479,286 | | 11/1969 | Gambaretto et al. . | |
| 3,572,443 | * | 3/1971 | Guise | 169/74 X |
| 3,602,312 | | 8/1971 | Rainaldi . | |
| 3,609,074 | | 9/1971 | Rainaldi et al. . | |
| 3,721,300 | * | 3/1973 | Becker et al. | 169/89 |
| 3,741,310 | * | 6/1973 | Hansen | 169/89 |
| 4,456,181 | | 6/1984 | Burnham . | |
| 5,002,757 | | 3/1991 | Gupta . | |
| 5,080,177 | | 1/1992 | Robin et al. . | |
| 5,084,190 | | 1/1992 | Fernandez . | |
| 5,093,013 | | 3/1992 | Sprague . | |
| 5,113,947 | | 5/1992 | Robin . | |
| 5,117,917 | * | 6/1992 | Robin et al. | 169/46 |
| 5,124,053 | | 6/1992 | Iikubo et al. . | |
| 5,135,054 | | 8/1992 | Nimitz et al. . | |
| 5,141,654 | | 8/1992 | Fernandez . | |
| 5,369,165 | | 11/1994 | Kato et al. . | |

FOREIGN PATENT DOCUMENTS

| | | | |
|---|---|---|---|
| 49026/90 | * | 8/1990 | (AU) . |
| 1187489 | | 2/1965 | (DE) . |
| 1132636 | | 11/1969 | (GB) . |
| 364445 | | 11/1974 | (SE) . |
| WO-A-91 04766 | | 8/1991 | (WO) . |
| WO-A-92 16597 | | 10/1992 | (WO) . |

OTHER PUBLICATIONS

Database WPI Week 9314, JPA 5049711, Abstract dated Mar. 3, 1993.

Database WPI Week 8839, JPA 63202686, Abstract dated Aug. 22, 1988.

* cited by examiner

*Primary Examiner*—Andres Kashnikow

(74) *Attorney, Agent, or Firm*—Smith Gambrell & Russell, LLP

(57) ABSTRACT

The present invention relates to a gas-liquid mixture especially for use as a fire extinguishing agent. The mixture contains a) at least one halogenated carbon or $C_1$–$C_{10}$ hydrocarbon, b) a chemical compound having a high steam pressure and a low boiling point, high solubility in the halogenated compound and a capacity of dispersing the halogenated compound, and/or an inert gas. The invention also relates to a fire extinguishing unit and a method for using the mixture.

3 Claims, 5 Drawing Sheets

GAS-LIQUID MIXTURE AS WELL AS FIRE-EXTINGUISHING UNIT AND METHOD FOR THE USE THEREOF

REFERENCE TO A RELATED APPLICATION

This is a division of application Ser. No. 08/264,956 filed Jun. 24, 1994, which in turn is a continuation of application Ser. No. 07/853,626 filed Mar. 19, 1992, now abandoned, both of which applications are relied on and incorporated herein by reference.

BACKGROUND OF THE INVENTION

The present invention relates to a gas-liquid mixture especially for use as a fire extinguishing agent, a fire extinguishing unit comprising the gas-liquid mixture, and a method for using the gas-liquid mixture.

Fire extinguishing agents are consumed in large amounts all over the world for fire protection in airplanes, ships, computer rooms, laboratories etc. Fire extinguishing agents are used both at home and in industry. A large consumer, of course in addition to fire departments, is the armed forces which also use large quantities for training purposes.

A standard agent for extinguishing fire is water, but in many cases water does greater damage than the fire itself, and besides water is unsuitable for extinguishing fire in e.g. electrical appliances. Carbon dioxide is also a fire extinguishing agent that is frequently used, but nor can this be used for all types of fire.

The searching for a clean, effective, non-toxic and also inexpensive fire extinguishing agent was initiated at the beginning of the 20th century. Then the so-called halons were developed. Halon is a tradename and comprises a number of halogenated hydrocarbons. The halon compounds are different combinations of carbon, chlorine, fluorine and bromine.

Two types of halon gas have been predominant, Halon 1301 and Halon 1211. Halon 1301 has mainly been used in so-called total flooding systems, and Halon 1211 has been used for hand-held extinguishers and so-called mobile fire extinguishing units (wheel-mounted or in fire-engines). Halon 1211 has also been used in permanent installations, such as local application systems. A further important field of application for Halon 1211 is the protection of different types of vehicle, civilian as well as military. Generally, engine compartments and other machinery spaces are to be protected, but also personnel rooms are objects to be protected.

The reason why several types of halon gas have been used is, among other things, their physical properties in relation to their field of application. Here, the boiling point, steam pressure and toxicity have been predominant parameters.

These halons are clean, effective and relatively non-toxic fire extinguishing agents, but in the 1970's it was considered to be proved that the halons had a strongly ozone-depleting effect. Since then a large number of the countries in the world have decided and bound themselves to reduce and, in the long run, discontinue the production and use of halons. The world production of fire extinguishing agents and particularly the halons is enormous. Merely in respect of Halon 1211 which in the first place is an agent for small and medium size portable fire extinguishers, the 1986 production amounted to 20,000 tons. There is thus an increasing interest all over the world to find a replacement for the halons.

A large number of experiments of finding such a replacement have already been made, but so far none has appeared to be as effective as halons and at the same time harmless to the environment.

Today it is required that a satisfactory fire extinguishing agent should be effective, non-toxic and harmless to the environment. The environmental aspect is today of utmost importance, and a new fire extinguishing agent should have above all a low ozone-depleting effect and a low greenhouse effect. The ozone-depleting effect is stated as an ODP value (Ozone Depletion Potential), and the greenhouse effect is stated as a GWP value (Global Warming Potential). The calculation of these values is well known within the art and will here not be discussed in more detail. The standard values of different countries have not been stipulated, but it is obvious that they will be substantially lower than the values of today's commercial halogen gases.

It is further required that a new fire extinguishing agent should be possible to use to refill existing containers ("drop-in agent"), without necessitating any large and expensive operations. Above all this applies to hand-held fire extinguishers since they are available in enormous amounts. Replacement of a nozzle or gasket could perhaps be accepted, but it would be far too expensive if for example the entire valve system had to be replaced.

One of the problems of finding a replacement for the halons is that, unfortunately, many agents which are less harmless to the environment and at the same time non-toxic are also less effective. For example, brominated hydrocarbons are effective but, on the other hand, highly toxic.

The aim of some experiments of finding a replacement has been to change from fully halogenated into semi-halogenated hydrocarbons, thereby especially reducing the amount of chlorine. Experiments with fully fluorinated hydrocarbons have also been performed. However, the agents become less effective when you pass from bromine to chlorine and then to fluorine. In respect of toxicity the opposite applies, i.e. bromine is the most toxic one and fluorine the least toxic, at least in combination with carbon.

The aim of other experiments has been to try to render a per se less effective agent more effective by means of different types of nozzles. For instance, there has been a great deal of work with the spreading of the agent precisely in the nozzle and pressure variations in the nozzle. The new agents which are less harmless to the environment are mainly liquids, and it has been tried in different ways to give these agents the energy required to obtain a sufficient streaming effect. There have also been experiments of adding various clean gases.

None of the experiments which are known so far has, however, resulted in a fire extinguishing agent that could replace today's halon gases.

One of the grounds for the present invention is the inventor's assumption that for replacing the above-mentioned, predominant types of halon gas, while also taking the new environmental parameters the ODP and GWP factors into consideration, it is not possible to design one or two "replacement gases" which satisfy both the old and the newly added requirements.

For a perfectly satisfactory and acceptable solution of the problem in future it is the inventor's opinion that it is not possible to design in a chemico-technical manner two gases with the qualities of Halon 1301 and 1211, but without unacceptable environmental or toxic side-effects.

The solution is the finding of a formula or a method for developing a replacement gas for different fields of application while considering the specific parameters that apply to the application involved. To achieve this, the replacement gases must in future be custom-made for their purpose. A much larger number of variants will be necessary to meet all the applications which are of interest for this type of fire extinguishing agent (so-called clean fire extinguishing agents).

SUMMARY OF THE INVENTION

We have surprisingly found that halogenated carbons, even the less effective ones, are possible to make highly effective by the addition of an appropriate dispersion medium in combination with a propellant agent, as will be discussed more fully below.

One object of the present invention is to provide a gas-liquid mixture which is especially useful as a fire extinguishing agent which can replace prior-art agents, e.g. the halons, and which is substantially just as effective but less harmless to the environment.

A further object of the present invention is to provide a gas-liquid mixture for use as a fire extinguishing agent which can be used in existing fire extinguishers and fire extinguishing systems.

One more object of the present invention is to provide a method for controlling, by means of the above-mentioned gas-liquid mixture, the spreading of a fire or embers.

A still further object of the present invention is to provide a fire extinguishing unit containing the above-mentioned fire extinguishing agent.

The gas-liquid mixture according to the invention comprises a) at least one halogenated carbon or $C_1$–$C_{10}$ hydrocarbon, or mixtures thereof;

b) at least one chemical compound having a high steam pressure and a low boiling point at NTP, high solubility in the halogenated compound according to a) and a capacity of dispersing the halogenated compound according to a), and/or at least one inert gas.

The fire extinguishing agent according to the invention comprises said gas-liquid mixture at a pressure of 2.5–45 bars.

The method according to the invention is characterised in that such a gas-liquid mixture is applied to the fire or embers, or in the vicinity thereof.

BRIEF DESCRIPTION OF THE DRAWINGS

The invention will now be described in more detail with reference to the accompanying drawings in which.

DESCRIPTION OF THE PREFERRED EMBODIMENTS

Figure 1:
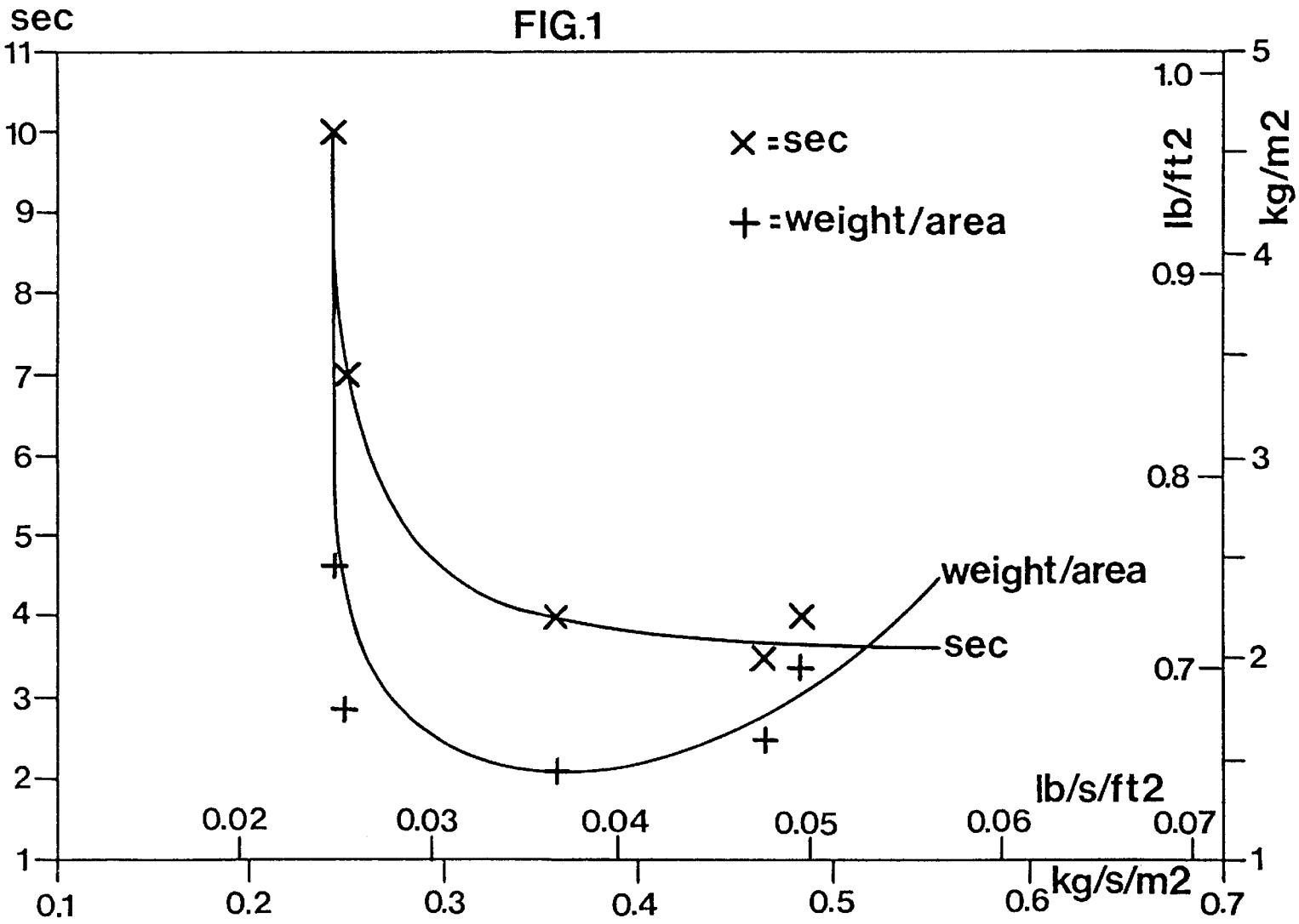
FIG. 1 is a graph of the results from extinguishing tests 1–6.

The gas-liquid mixture according to the invention comprises at least one halogenated carbon or $C_1$–$C_{10}$ hydrocarbon, or mixtures thereof.

The halogenated hydrocarbon is the basis in the gas-liquid mixture according to the present invention and can be a $C_1$–$C_{10}$ hydrocarbon which is fully or partly halogenated. The halogen substituent is F, Cl, Br or I, preferably F, Cl and I. Suitable halogenated hydrocarbons which can be utilised according to the invention are compounds from the groups CFC, HCFC, FC and HFC, preferably HCFC and HFC. Examples of such compounds are $CHCl_2CF_3$, $CHClFCF_3$, $CHF_2CF_3$, $CF_3CHFCF_3$, $C_4F_{10}$, $C_5F_{12}$, $C_6F_{14}$, $CF_3I$, $CF_3CF_2I$, $CHF_2I$, or mixtures thereof. As a basis, use can also be made of a halogenated carbon or mixtures of halogenated carbon and halogenated hydrocarbons. The basis is the main component of the agent and is used in an amount of at least 60% by weight, based on the total weight of the mixture, preferably 75–98% by weight, most advantageously 90–98% by weight.

The basis is an extinguishing-active agent from the groups carbon compounds and hydrocarbon compounds. The extinguishing-active capacity is taken into consideration when selecting a suitable compound or combinations of compounds. The following parameters are characteristic of an agent having an excellent extinguishing-active capacity.

High adsorbance of radiation within the wave range 3500–7500 Å.

A molecular weight in the range of 70–400.

The compounds are not allowed to dissociate by heating at temperatures below 400° C., without contributing to the reduction of oxygen. Such substances are however not used in closed spaces.

The inertion capacity when diluted in fuel-air mixture should be in the range of 5–60% by volume.

Triple point <−30° C.

For a satisfactory extinguishing capacity, it must further be possible to apply the basis to the flame and the basis must be able to reach to the fire center. This process cannot be entirely controlled merely by a propellant and mechanical equipment (nozzle).

This is achieved by dissolving a dispersing agent in the basis. As dispersing agent according to the invention, use is made of at least one chemical compound having high solubility in the basis and a satisfactory capacity of dispersing the basis.

A basic demand placed on the dispersing agent is that it should be a gas or close to a gas after being expelled from the pressurised container for the fire extinguishing agent.

A suitable dispersing agent according to the invention has a steam pressure in the range of 2.5–45 bars at NTP and a boiling point which is ≦−50° C. Additional parameters to be considered when selecting a suitable dispersing agent are:

The agent should be soluble in the basis in the range of 0.5–40% by weight.

Is should cause a steam or gas pressure in the extinguishing system, at a temperature from −30 to +40° C. when dissolved in the basis, which is in the range of 2.5–45 bars.

It should quickly expand and disperse the basis in combination with a propellant and nozzle, whereby up to 70% of the basis forms droplets in the range of 10 μm–0.5 mm. The size is determined by the spraying distance and the molecular weight of the basis. Below 10 μm, the gas has but small possibilities of penetrating the energy pressure exerted by the flame. Above 0.5 mm, the liquid will be sprayed into the flame and have a poor mixing and inerting effect.

It should assist in the extinguishing operation by reducing the radiation and effect of the flame. This is effected in that the extinguishing agent absorbs such an amount of heat from the flame that the combustion discontinues.

Normally, the dispersing agent does not cause a high streaming effect.

Examples of chemical compounds that can be used according to the invention are $SF_6$, $CF_4$, $CHF_3$, $CH_4$ and $CO_2$, or mixtures thereof.

The third component in the gas-liquid mixture according to the invention is an inert gas, or mixtures thereof.

By inert is here meant a gas which at the temperatures which are normal in case of fire does not react or at least does not react in such a manner that the fire is promoted.

The inert gas according to the invention functions as a propellant, and a suitable gas is e.g. $N_2$, Ar, Kr and Xe, or mixtures thereof, preferably $N_2$ or Ar.

When selecting a suitable propellant for the invention, the following parameters are taken into consideration.

1.—The gas should have a critical temperature which is $\leqq -50°$ C.

2.—It should have acceptable solubility in the mixture of basis and dispersing agent, i.e. >0.2% by weight.

3.—It should be in gaseous phase at an ambient temperature according to Item 1.

4.—It should be able to produce a propelling pressure between 8 and 45 bars in the extinguishing system.

5.—It should contribute by inerting the fuel-air mixture.

In order to obtain a functioning fire extinguishing agent, a sufficient amount of energy must be supplied to the basis. The gas produces the required expulsion energy, but frequently has low solubility in the hydrocarbon. The dispersing agent, however, has high solubility in the hydrocarbon and, together with the gas, a combined effect is achieved.

Thus, the gas-liquid mixture according to the invention preferably contains three components: a basis, a dispersing agent and a propellant. Depending on the specific use and the physical properties of the compounds included, it is also possible to use only the combination of basis and dispersing agent, or basis and propellant. This is possible when, for example, the dispersing agent also has a certain propellant effect or, vice versa, when the propellant has a comparatively high solubility in the basis.

As mentioned above, the basis is used with a content of at least 60% by weight of the total weight of the mixture. When all three components are used, the inert gas is suitably utilised with a content not exceeding 10% by weight.

The preferred contents of the three components in a gas-liquid mixture according to the invention are in the following ranges:

75–95% by weight of basis

2–10% by weight of dispersing agent 0.2–4% by weight of inert gas.

An especially preferred combination of three components for hand-held fire extinguishers (working pressure up to 15 bars) are $CHCl_2CF_3$ as the basis, $CF_4$ as the dispersing agent, and Ar as the inert gas. For sprinkler systems, a suitable combination is $CHCl_2CF_3$+$CHF_3$+Ar, working pressure 15–25 bars.

Without adopting a specific theory, it seems as if the combination of the steam pressure and the boiling point of the additives is most important.

Since the extinguishing basis has a very low steam pressure at NTP and a relatively high molecular weight, it can hardly disperse in a nozzle under the action of the propellant pressure only, e.g. 5–15 bars (the range of working pressure of the extinguishing container), provided that the discharge (amount per unit of time) through the nozzle should maintain the given values for satisfactory fire extinction. The extinguishing basis will leave the nozzle as a slightly dispersed jet.

This can be changed in two ways: by increasing the propellant pressure (which however is limited by the working pressure) or by adding a dispersing agent.

According to the invention, a dispersing agent and also as much propellant as possible are dissolved in the extinguishing basis at the working pressure.

By dissolving a dispersing agent which, after the adiabatic expansion in the nozzle, has a pressure exceeding the atmospheric pressure, the following is achieved. When the dispersing agent is dissolved in the basis and evenly distributed, the basis will expand at a sudden decrease of pressure and want to leave the basis in the form of small bubbles. Passing through the nozzle, these bubbles will decompose the basis into an aerosol. Depending on the design of the nozzle and the propellant pressure, these aerosols are caused to stream a certain distance, while continuing to disperse.

The agent according to the invention can be used in all types of fire extinguisher and fire extinguishing system, i.e. both in hand-held extinguishers, big and small, and in sprinkler systems. The agent can also be used for all types of fire. The three or two components are combined owing to the field of application and the type of extinguisher involved. In e.g. hand-held extinguishers, a fire extinguishing agent is required, which has a sufficient expulsion power, i.e. the agent should reach the fire center. In a sprinkler system however, there is not the same need for expulsion power, but the space, in which a certain concentration and distribution of the substance should be achieved, is frequently limited.

Moreover, the agent can be used in existing fire extinguishers and fire extinguishing systems, in many cases merely by changing a gasket or nozzle.

A number of experiments and also comparative experiments have been made, while using different combinations of the fire extinguishing agent according to the present invention. The known substances with which the inventor has compared his own agent are i.a. Halon 1211 and Halon 1301. The agent according to the present invention has appeared to be essentially as effective as the halons, but has a substantially lower negative effect on the environment than the halons. Below follows a number of non-restrictive Examples.

EXAMPLES OF MIXTURES ACCORDING TO THE PRESENT INVENTION

| COMPONENT | CHEMICAL SUBSTANCE | MIXTURE % BY WEIGHT |
|---|---|---|
| Example 1 | | |
| Basis | $CHCl_2CF_3$ | 96.54 |
| Dispersing agent | $CF_4$ | 2.60 |
| Propellant | Ar | 0.86 |
| | | 100.0 |
| Example 2 | | |
| Basis | $CHCl_2CF_3$ + | 48.40 |
| | $C_6F_{14}$ | 47.80 |
| Dispersinq agent | $CF_4$ | 2.85 |
| Propellant | Ar | 0.95 |
| | | 100.0 |
| Example 3 | | |
| Basis | $CF_3CHFCF_3$ | 97.0 |
| Dispersing agent | $CF_4$ | 2.3 |
| Propellant | Ar | 0.7 |
| | | 100.0 |

-continued

| COMPONENT | CHEMICAL SUBSTANCE | MIXTURE % BY WEIGHT |
|---|---|---|
| Example 4 | | |
| Basis | $CF_3CHFCF_3$ | 94.1 |
| Dispersing agent | $CHF_3$ | 5.5 |
| Propellant | $N_2$ | 0.4 |
| | | 100.0 |
| Example 5 | | |
| Basis | $C_4F_{10}$ | 95.6 |
| Dispersing agent | $CF_4$ | 3.6 |
| Propellant | Ar | 0.8 |
| | | 100.0 |
| Example 6 | | |
| Basis | $C_5F_{12}$ | 96.2 |
| Dispersing agent | $CF_4$ | 3.1 |
| Propellant | Ar | 0.7 |
| | | 100.0 |
| Example 7 | | |
| Basis | $C_6F_{14}$ | 96.6 |
| Dispersing agent | $CF_4$ | 3.7 |
| Propellant | Ar | 0.7 |
| | | 100.0 |
| Example 8 | | |
| Basis | $CF_3CHFCF_3$ + | 48.5 |
| | $CHCl_2CF_3$ | 48.5 |
| Dispersing agent | $CF_4$ | 2.1 |
| Propellant | Ar | 0.9 |
| | | 100.0 |
| Example 9 | | |
| Basis | $CHF_2CF_3$ | 98.6 |
| Propellant | Ar | 1.4 |
| | | 100.0 |
| Example 10 | | |
| Basis | $CHF_2CF_3$ + | 45.2 |
| | $CHCl_2CF_3$ | 45.2 |
| Dispersing agent | $CF_4$ + | 3.1 |
| | $CO_2$ | 5.2 |
| Propellant | Ar | 1.3 |
| | | 100.0 |
| Example 11 | | |
| Basis | $CHCl_2CF_3$ | 94.40 |
| Dispersing agent | $SF_6$ | 4.85 |
| Propellant | Ar | 0.75 |
| | | 100.0 |
| Example 12 | | |
| Basis | $CHCl_2CF_3$ + | 46.00 |
| | $C_6F_{14}$ | 46.00 |
| Dispersing agent | $CHF_3$ + | 2.85 |
| | $SF_6$ | 4.20 |
| Propellant | Ar | 0.85 |
| | | 100.0 |
| Example 13 | | |
| Basis | $CHCl_2CF_3$ + | 47.90 |
| | $C_4F_{10}$ | 47.95 |
| Dispersing agent | $CF_4$ | 3.30 |
| Propellant | Ar | 0.85 |
| | | 100.0 |

-continued

| COMPONENT | CHEMICAL SUBSTANCE | MIXTURE % BY WEIGHT |
|---|---|---|
| Example 14 | | |
| Basis | $CHCl_2CF_3$ + | 48.45 |
| | $C_5F_{16}$ | 47.50 |
| Dispersing agent | $CF_4$ | 3.10 |
| Propellant | Ar | 0.95 |
| | | 100.0 |
| Example 15 | | |
| Basis | $CHCl_2CF_3$ + | 48.00 |
| | $CHClFCF_3$ | 48.00 |
| Dispersing agent | $CF_4$ | 3.20 |
| Propellant | Ar | 0.80 |
| | | 100.0 |
| Example 16 | | |
| Basis | $CF_3CHFCF_3$ | 98.5 |
| Propellant | Ar | 1.5 |
| | | 100.0 |

Mixtures Used in Extinguishing Tests

The gas mixtures used in the extinguishing tests below performed at the Swedish National Testing and Research Institute, Report No. 91 R 30165 of Jan. 23, 1992 were composed as follows.

| | | |
|---|---|---|
| Extinguishing Tests 1–5 (Pool Fires) | | |
| 2,2-dichloro-1,1,1-trifluoroethane $CHCl_2CF_3$ | 97.18% by weight | (Basis) |
| Tetrafluoromethane $CF_4$ | 1.91% by weight | (Dispersing agent) |
| Argon Ar | 0.91% by weight | (Propellant) |
| Final pressure 15 bars at 15° C. | — | |
| in all | 100% by weight | |
| Extinguishing Tests 6–13 (Mock-up of Engine Room) | | |
| 2,2-dichloro-1,1,1-trifluoroethane $CHCl_2CF_3$ | 91% by weight | (Basis) |
| Trifluoromethane $CHF_3$ | 8% by weight | (Dispersing agent) |
| Argon Ar | 1% by weight | (Propellant) |
| Final pressure 15 bars at 15° C. | — | |
| in all | 100% by weight | |
| Extinguishing Tests 14–20 (Mock-up of Engine Room) | | |
| 2,2-dichloro-1,1,1-trifluoroethane $CHCl_2CF_3$ | 94% by weight | (Basis) |
| Trifluoromethane $CHF_3$ | 4.5% by weight | (Dispersing agent) |
| Argon Ar | 1.5% by weight | (Propellant) |
| Final pressure 15 bars at 15° C. | — | |
| in all | 100% by weight | |

The method and apparatus used are apparent from the above report. The results in extinguishing tests 1–5 have been processed in the form of a diagram, which is illustrated in FIG. 1, and illustrate the optimisation graph, i.e. at the minimum value the best application amount per unit of area is to be found. To the left of the limit graph the fire cannot be extinguished, and to the right of the minimum value an amount of extinguishing agent is applied without any actual effect (which is apparent from the amount-time-area graph which is leveling away).

The symbol X is the time in seconds to extinguish the pool fire, and the symbol + is the amount of extinguishing agent required in pounds per square feet.

One of the preferred bases for the fire extinguishing agent according to the present invention is $CHCl_2CF_3$ which has an acceptable extinguishing capacity and toxicity, very low CDP and GWP values.

Examples 17–21

Figure 2:
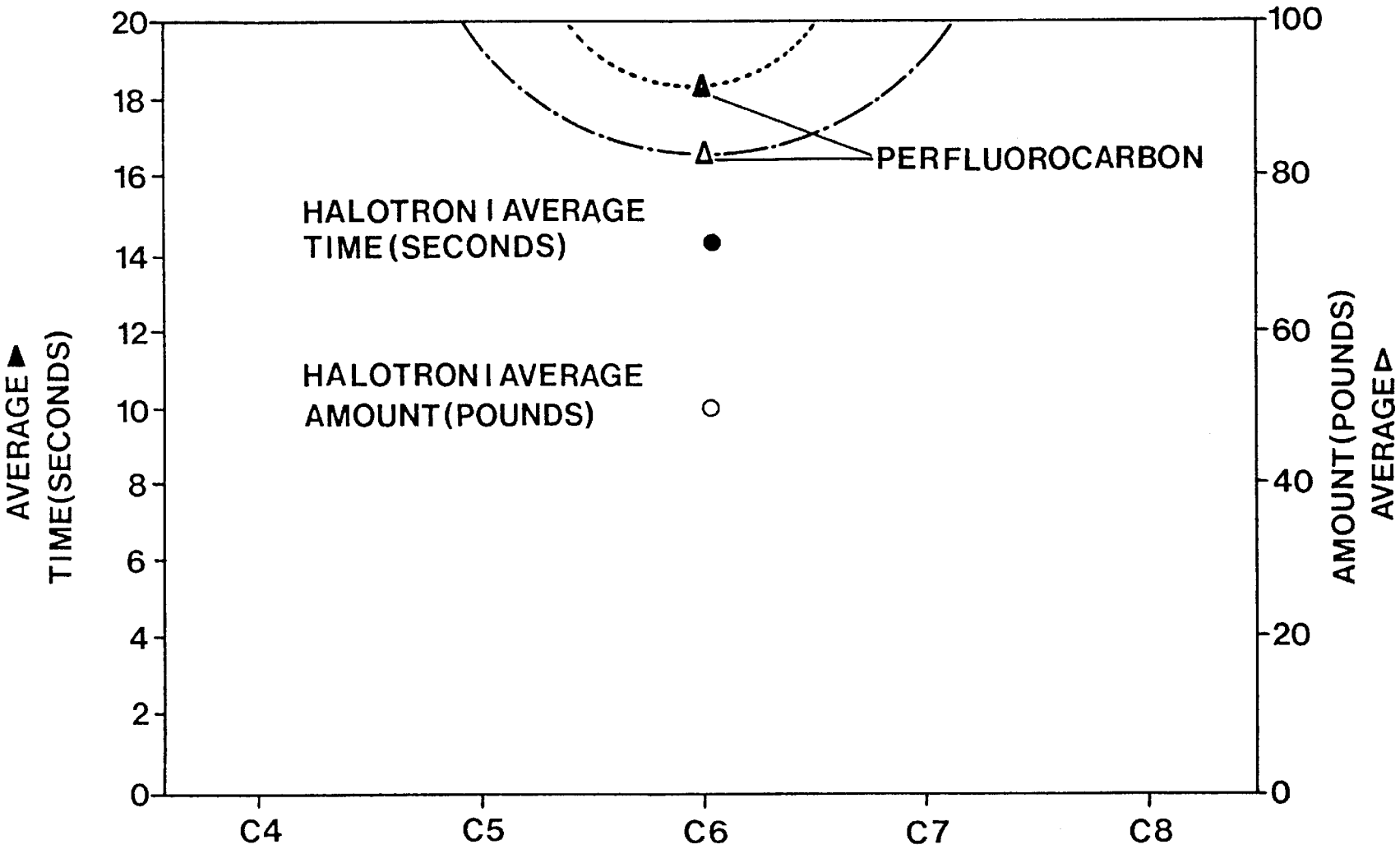
FIGS. 2–4 are graphs of the results from comparison tests from examples 17–19.
Figure 3:
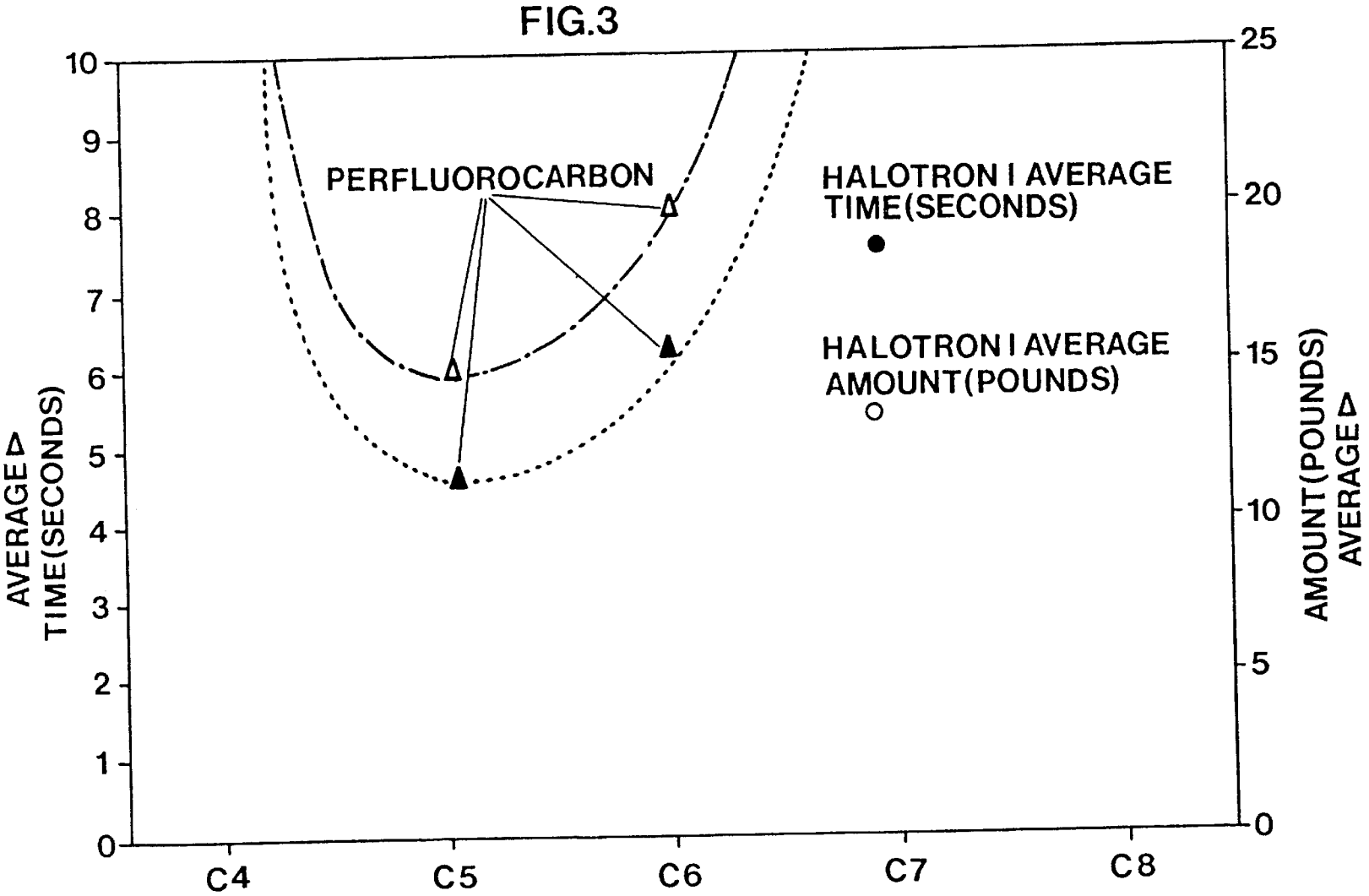
Figure 4:
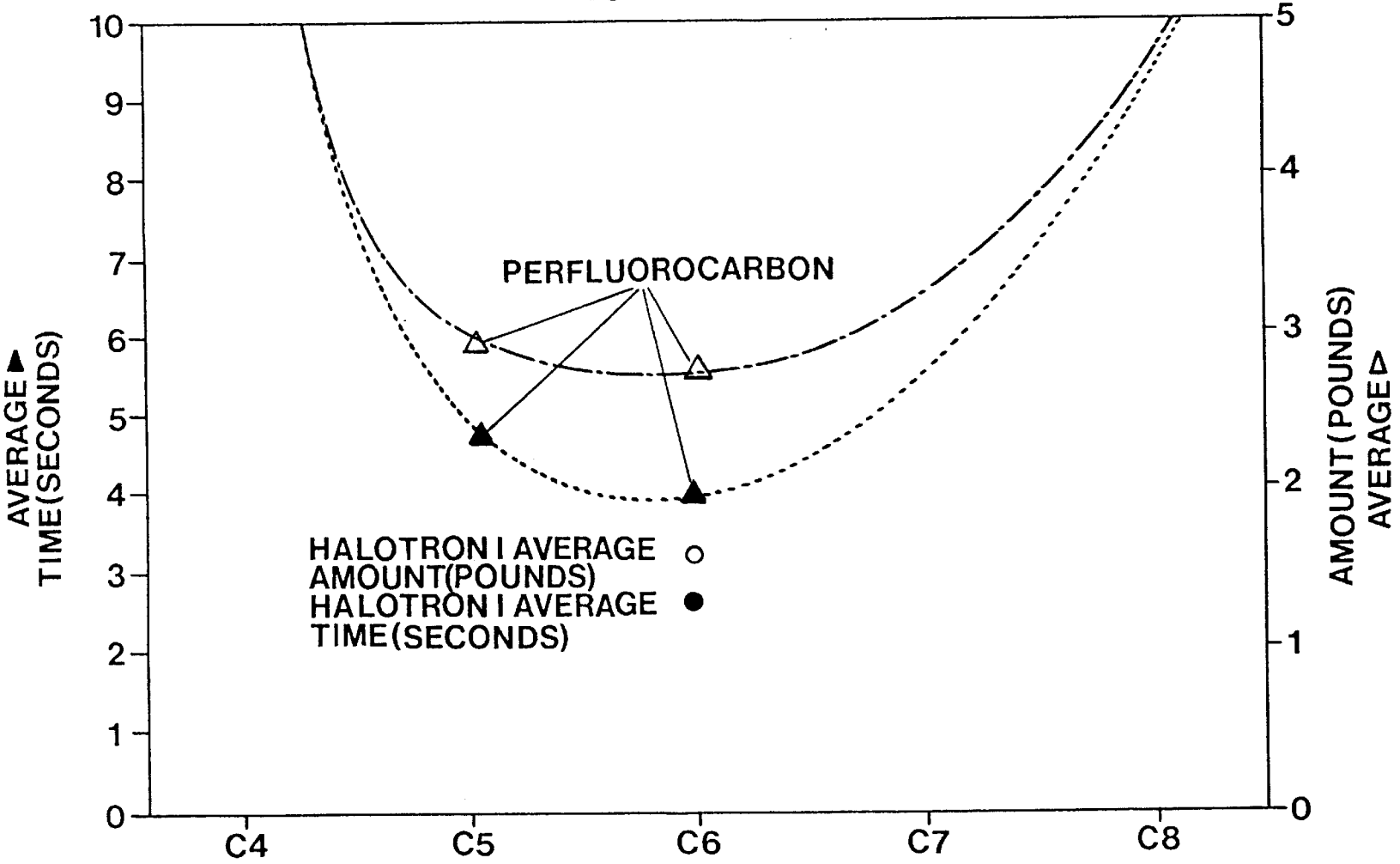

In the following examples 17–21 we have tested a fire extinguishing agent called Halotron I, a gas-liquid mixture according to the present invention. In FIGS. 2–4 these Halotron I results have been compared with two perfluorocarbons $+N_2$; $C_5F_{12}$ and $C_6F_{14}$. Halotron I is a mixture comprising 97.18% $CHCl_2CF_3$, 1.91% $CF_4$ (5 bar) and 0.91% Ar (10 bar), giving a final pressure of 15 bar. The perfluorocarbons $C_5F_2$ and $C_6F_{14}$ have very low ODP values, but unfortunately they are extremely stable and the GWP values are thus unexeptably high.

The basis, $CHCl_2CF_3$, of Halotron I has an ODP value of 0.016 and a GWP value of 0.019. The ODP and GWP values of the Halotron I mixture is approximately the same, since the amount of $CF_4$ and Ar added is very small.

In Table I below the tests with Halotron I are specified. The perfluorocarbons have been submitted to the same tests. All the tests are performed according to US standards. The JP-4 fuel is a standard aircraft fuel.

FIG. 4 shows the results from 3-D fire tests and the Halotron values are average values from Examples 19a–b.

The 3-D fire test is explained below.

3-D Flowing Fuel Engine Mock-up

The test setup is designed to simulate an aircraft engine fire where an engine is attached to the under surface of an aircraft wing, a fuel line has broken, and the fuel has spilled from the engine onto the runway. This test setup is becoming recognized as the standard United States Air Force fire-fighter training scenario. The simulation apparatus is constructed of two different-sized barrels welded one inside the other. The inner barrel is a standard 55-gallon drum with a diameter of 22.5 inches and a length of 35 inches. The outer drum is an overpack drum with a diameter of 33 inches and a length of 44 inches. The smaller drum is welded inside the larger barrel with support rods that are kept the inner barrel centered within the outer barrel. This structure is suspended over the fire pit, with the front edge 15 degrees lower than the rear of the apparatus, on a swivel mount attached to a horizontal steel pipe boom. A fuel spray system provides a constant supply of running fuel.

A flexible fuel line runs from a pressurized fuel pumping truck along the vertical and horizontal sections of the boom to a vertically mounted multidirectional spray bar inside the inner barrel. The spray bar is shielded so that the fuel sprays toward the front, or lower end, of the apparatus. The fuel sprays into the inner barrel, and a portion of the fuel flows into the outer barrel through circular holes cut in the bottom of the inner barrel. The remainder of the fuel flows the length of the inner barrel, into the overlapped edge of the outer barrel, and out of the apparatus into the circular fire pit located 4.5 feet below the apparatus. Fuel flow is regulated at an average rate of 3.5 gallons/minute. A 16-inch tall circular metal containment ring is placed in the center of the fire pit below the engine nacelle to contain the flowing fuel within a 75 $ft^2$ surface area.

In Table II comparing tests 20 and 21 with Halon 1211 are presented.

TABLE I

HALOTRON I TESTING

| EXAMPLE | AGENT USED | FIRE PAN SIZE (JP-4 Fuel) | EXTINGUISHER SIZE | TIME TO EXTINGUISH | AMOUNT USED | AVERAGE FLOW RATE | COMMENTS |
|---|---|---|---|---|---|---|---|
| 17 a | Halotron I | 4 sq. ft. | Amerex 5 lb. | 3.17 sec. | 1.00 kg., 2.2 lbs. | 0.69 lbs/sec. 0.31 kg/sec. | 56 oz. of JP-4, 30 sec. pre-burn, 200 PSI, 45 F, 2,6 kg to start |
| 17 b | Halotron I | 4 sq. ft. | Amerex 5 lb. | 2.38 sec. | 0.70 kg., 1.5 lbs. | 0.60 lbs/sec. 0.3 kg/sec. | 200 PSI, 2.4 kg to start, smaller nozzle |
| 17 c | Halotron I | 4 sq. ft. | Amerex 5 lb. | 2.26 sec. | 0.60 kg., 1.3 lbs. | 0.59 lbs/sec. 0.27 kg/sec. | Different nozzle, 200 PSI |
| 17 d | Halotron I | 4 sq. ft. | Amerex 5 lb. | 2.96 sec. | 0.86 kg., 1.9 lbs. | 0.64 lbs/sec. 0.29 kg/sec. | Same nozzle, 200 PSI |
| 18 a | Halotron I | 32 sq. ft. | Amerex 20 lb. | 6.35 sec. | 4.63 kg., 10.2 lbs. | 1.6 lbs/sec. 0.72 kg/sec. | 200 PSI, 10 mm nozzle |
| 18 b | Halotron I | 32 sq. ft. | Amerex 20 lb. | 6.98 sec. | 6.76 kg., 14.9 lbs. | 2.13 lbs/sec. 0.96 kg/sec. | 200 PSI, 10 mm nozzle |
| 19 a | Halotron I | Engine 3-D | Amerex 150 lb. | 19.08 sec. | 27.0 kg., 60 lbs. | 3.1 lbs/sec. 1.4 kg/sec. | Fuel flow 5 gal/min unit overfilled (180 lb) sputtered (lost press.) |
| 19 b | Halotron I | Engine 3-D | Amerex 150 lb. | 11.29 sec. | 22.3 kg., 49.5 lbs. | 4.4 lbs/sec. 2.0 kg/sec. | Unit had 120 lbs to start, 5 gal/min fuel flow, much better dispersion, 13 mm nozzle |

FIG. 2 shows the results from 4 $ft^2$ fire tests and the spots • and ○ are average values from Examples 17a–d in Table I. It clearly appears from FIG. 2 that Halotron I is superior to both $C_5F_{12}+N_2$ and $C_6F_{14}+N_2$ with regard to amount required to extinguish the fire as well as the time needed.

FIG. 3 shows the results from 32 $ft^2$ fire tests 18a–b. In these tests 20 lb capacity extinguisher were used for Halotron I and 50 lb capacity extinguisher for the perfluorocarbons $C_5F_{12}$ and $C_6F_{14}$. With this in mind the Halotron results are very good.

TABLE II

| EXAMPLE | AGENT USED | FIRE PAN SIZE (JP-4 Fuel) | EXTINGUISHER SIZE | TIME TO EXTINGUISH | AMOUNT USED | AVERAGE FLOW RATE | COMMENTS |
|---|---|---|---|---|---|---|---|
| 20 | Halon 1211 | 32 sq. ft. | Amerex 20 lb. | 7.8 sec. | 6.2 kg., 13.6 lbs. | 1.74 lbs/sec. 0.79 kg/sec. | 195 PSI |
| 21 | Halon 1211 | Engine 3-D | Amerex 150 lb. | 9.51 sec. | 17.2 kg., 38 lbs. | 4.0 lbs/sec. 1.8 kg/sec. | 200 PSI, fuel flowing at 5 gal/min., unit started with 110 lbs. of 1211, not 150 |

The 3-D fire test, being a standard US-test, is an extremely difficult test and it was very surprising to see the excellent results of Halotron I, both with reference to Halon 1211 and the perfluorocarbons.

The results from the Halon I tests are both unexpected and surprising. Halon 1211 is regarded as an outstanding medium taking into account extinguishing time and amount, but not the environmental factors.

Examples 18a, 18b, 20 and 21 show that Halotron I is equally efficient.

The present invention also relates to a fire extinguishing unit comprising a container for the above-mentioned fire extinguishing agent filled with said agent at a certain working pressure. Hand-held extinguishers normally operate at a pressure of 5–15 bars, and larger systems, such as sprinkler systems, normally at 15–25 bars.

Figure 5:
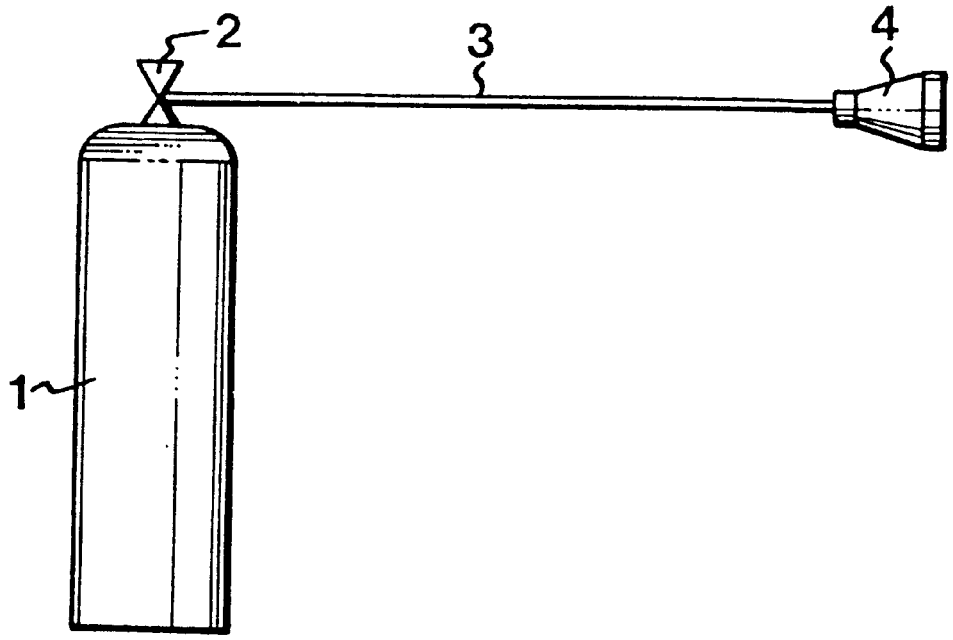
FIG. 5 is a schematic view of a fire-extinguishing unit according to the invention.

FIG. 5 is a schematic view of a hand-held extinguisher comprising a container 1, a valve 2, a hose 3 and a nozzle 4.

To further increase the effectiveness of the fire extinguishing agent according to the present invention, the fire extinguishing unit can be provided with different types of nozzle and moreover the filling degree can be varied, i.e. the container can be filled with a smaller or larger amount of the gas.

It has been found that a particularly favourable effect is obtained if the fire extinguishing agent according to the present invention, with which a container is filled, is combined with a conical nozzle, i.e. having a nozzle member which diverges in the direction of discharging the fire extinguishing agent.

Figure 6:
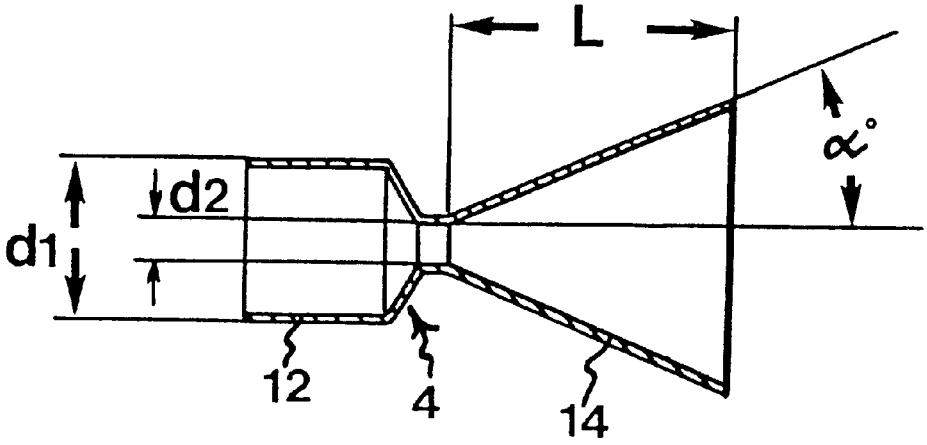
FIG. 6 is a schematic fragmentary view of a nozzle for the fire extinguishing unit according to the invention.

FIG. 6 illustrates schematically a preferred nozzle 4 according to the present invention. The nozzle 4 comprises a connection 12 and a nozzle member 14. The nozzle or the connection has an inlet diameter $d_1$ and the nozzle member an inlet diameter d2. The nozzle member has a length L and an outlet angle $\alpha$. When utilising the present invention, $d_1$, $d_2$, L and $\alpha$ have the following values.

$$d_2<d_1<1.4d_2$$

$$1.5d_2<L<15d_2$$

$$10°<\alpha<40°$$

Further the present invention relates to a method for controlling the spreading of a fire or embers by applying a gas-liquid mixture as stated above.

The combination of basis, dispersing agent and propellant affects the different degrees of filling which are required in the extinguishing agent container.

To provide a suitable particle size of the droplets and a correct dispersion ratio, the gas-liquid mixture according to the invention must pass a nozzle member which is designed and optimised according to the fields of application where the agent is intended to be used. For e.g. portable fire extinguishers and mobile units where the extinguishing agent is adapted to be applied to the fire center by spraying with a hose or some other arrangement, an optimal effect is achieved if the gas mixture is applied through a nozzle of the design illustrated in FIG. 6.

For stationary systems, i.e. sprinkler systems, the streaming of the extinguishing agent is in most cases of secondary importance. Instead the dispersion and evaporation of the gas mixture should be as quick as possible.

The relationship between extinguishing-active basis, dispersing agent and propellant is of great importance in different fields of application. The extinguishing effect when the agent is applied directly, as is the case when a portable fire extinguisher is used, is completely dependent on the applied amount per unit of time. However, even if this parameter is dominating, the spray pattern is also extremely important.

If the jet is too concentrated, it penetrates the flames without any particular extinguishing effect. If the jet is in a too finely divided state, the extinguishing agent is moved away from the fire by hot fire gases.

Thus, not only the velocity of application is significant, but also the fact that the consistency of the extinguishing agent as it reaches the flames is correct. For an optimal extinguishing effect, the mass flow should be as high as possible, but at the same time the amount of estinguishing agent discharged must disperse and be evaporated, thereby preventing the extinguishing agent both from penetrating the flames and from being moved away from the fire.

This condition can be achieved but with the correct combination of the gas-liquid mixture (extinguishing-active basis, dispersing agent and propellant) and a correctly designed nozzle member.

A person skilled in the art can modify the invention for different applications. All such combinations are within the scope of the invention.

What is claimed is:

1. A fire extinguishing unit, comprising a container for a fire extinguishing agent, a valve, a hose, and a nozzle, wherein said container contains a gas-liquid fire extinguishing agent consisting essentially of:

(a) at least 75 to 98% by weight of a member selected from the group consisting of halogenated carbon, halogenated $C_1$–$C_{10}$ hydrocarbon, and mixtures thereof, wherein the halogen is at least one of F, Cl, and I, and wherein the selected member has sufficient fire extinguishing active capacity, (b) $CF_4$, and (c) at least one propellant gas containing argon.

2. The fire extinguishing unit according to claim 1 which comprises a nozzle having a conical nozzle member for discharging said fire extinguishing agent, the nozzle member diverging in the direction of discharging the fire extinguishing agent.

3. The fire extinguishing unit according to claim 2 wherein the nozzle comprises:

a connecting portion, having an inlet diameter $d_1$ which connects the nozzle with the fire extinguishing unit, and said conical nozzle member, operably connected to the connecting portion and having an inlet diameter $d_2$, an outlet angle $\alpha$, and a length L, wherein the inlet diameter $d_1$ of the connecting portion is greater than or equal to the inlet diameter $d_2$ of the conical nozzle member and is less than 1.4 times the inlet diameter $d_2$ of the conical nozzle member, the length L of the conical nozzle member is greater than 1.5 times the inlet diameter $d_2$ of the conical nozzle member and is less than 15 times the inlet diameter $d_2$ of the conical nozzle member, and the outlet angle $\alpha$ is greater than 10° and less than 40°.

* * * * *